United States Patent [19]

Hoffmann et al.

[11] Patent Number: 4,483,671

[45] Date of Patent: Nov. 20, 1984

[54] APPARATUS FOR MAKING MULTILAYER POWDER BLANKS

[75] Inventors: Alfred Hoffmann, Bilthoven; Martin B. Verburgh, Amersfoort, both of Netherlands

[73] Assignee: SKF Industrial Trading & Development Co. B.V., Nieuwegein, Netherlands

[21] Appl. No.: 942,757

[22] Filed: Sep. 15, 1978

[30] Foreign Application Priority Data

Sep. 20, 1977 [DE] Fed. Rep. of Germany ..... 2742254

[51] Int. Cl.[3] ..... B28B 1/20

[52] U.S. Cl. ..... 425/435; 425/78; 425/256; 425/447

[58] Field of Search ..... 425/256, 258, 259, 434, 425/435, 447, DIG. 44, 78, DIG. 19; 222/553

[56] References Cited

U.S. PATENT DOCUMENTS

| | | | |
|---|---|---|---|
| 1,840,027 | 1/1932 | Fetter | 425/435 X |
| 1,924,057 | 8/1933 | Draper et al. | 222/553 X |
| 2,440,754 | 5/1948 | Nagel | 425/DIG. 44 |
| 2,937,421 | 5/1960 | Taccone | 425/DIG. 44 |
| 3,193,900 | 7/1965 | Wendt | 425/DIG. 44 |
| 3,328,845 | 7/1967 | Ludwig | 425/258 X |
| 3,773,447 | 11/1973 | Barratt | 425/435 X |
| 3,945,782 | 3/1976 | Farahar | 425/435 X |

*Primary Examiner*—Jay H. Woo
*Assistant Examiner*—Joel S. Baden
*Attorney, Agent, or Firm*—Daniel M. Rosen; J. David Dainow

[57] ABSTRACT

A method and apparatus for manufacturing a multilayer powder blank, and the product of such manufacture which is suitable for subsequent extrusion. A hollow cylindrical container with its central axis oriented horizontally is rotated while powder is allowed to fall from a powder distribution tube in the center of the container downward onto the inner surface of the rotating wall, thereby forming successive layers of powder which are maintained in position by centrifugal forces acting thereon. The powder blank consisting of the multiple layers is removed from the container, isostatically compressed, and finally sintered, with fusion of the outer powder layers into a fused, water-tight coating.

5 Claims, 5 Drawing Figures

APPARATUS FOR MAKING MULTILAYER POWDER BLANKS

BACKGROUND OF THE INVENTION

The invention concerns an extruded molding from powdered materials, of solid or hollow cross-section, and a process for its manufacture.

The extrusion of sintered powder blanks by means of a ram to form given types of moldings is a well-known process in powder metallurgy. In addition to other factors, for example, the dimensions of the ram and the die, matching of the ram pressure and the friction occurring during extrusion is of particular importance. To minimize the friction as far as possible, lubricants such as paraffin, molybdenum sulphite or glass are used. Powdered glass in particular, however, imparts a rough surface to a hot-extruded molding because of the glass deposits left upon it, with the result that the molding generally required further processing. The use of powdered glass as a lubricant is also unsatisfactory in terms of dimensional accuracy and causes relatively high eccentricity of the extruded molding.

Although the friction occurring in conventional extrusion processes, particularly "wall friction" is reduced to a certain extent by the lubricants specified, the remaining frictional resistance can, in certain cases, be so high as to place limitations on the length of the extruded blank. This applies particularly to the extrusion of tubing of relatively small internal diameter.

The task of the present invention is therefore to produce from powdered materials a molding relatively long in relation to its cross-section and of relatively high density and dimensional accuracy, while having a gas and liquid-tight and smooth external and/or internal layer. It is a further objective to provide an economical process by means of which a molding of this type can be easily manufactured.

SUMMARY OF THE INVENTION

In the present invention a molding is produced by hydrostatic extrusion which has an external and/or internal layer of a fused-on metallic compound which completely seals the pores of its skin zone. This molding can be manufactured easily according to the invention through the preparation of a pre-molding consisting of powdered materials, which has a coating, and later forming the external and/or internal layer, which melts during a subsequent sintering process and penetrates partially into the pores of the skin zone of the pre-molding, thereby sealing them up; the pre-molding is then hydrostatically extruded after the sintering process.

The coating, that is, the external and/or internal layer consisting of a metallic compound, advantageously fulfills three important functions:

(a) The fused-on metallic compound imparts to the pre-molding a surface layer which is impervious to hydraulic fluids, so that hydrostatic extrusion is possible;

(b) The fused-on metallic compound simultaneously acts as a lubricant during extrusion;

(c) The final extruded molding is simultaneously given a protective layer, for example, against corrosion.

It should be mentioned in this connection that a process for manufacturing an isostatically pressure-sintered molding is already known from German Pat. No. 2,208,250, in which sintering and compression are combined in a single operation. To prevent the gaseous pressure medium used from penetrating through the porous surface of the molding into the interior of the molding, a pre-molding is first cold-formed and then provided with a coating. This coating can consist of enamel, glass or nickel and is applied to the pre-molding by flame-spraying, plasma-spraying or dipping. After the coating is applied, the pre-molding is heated at reduced pressure in a vacuum kiln, so that the coating melts and forms a gas-tight seal on the surface of the pre-molding. The article thus treated is then isostatically pressure-sintered under the direct action of an inert, gaseous pressure medium.

The sole purpose of the coating applied in the known process is to enable isostatic pressure sintering to be performed. It also renders unnecessary the pressure vessels which would otherwise be required to encapsulate the powdered materials to be molded. This known process is however not comparable with the process of the present invention, since different conditions prevail in isostatic pressure sintering from those in hydrostatic extrusion.

In applying the invention it is particularly advantageous to use a hard solder as the metallic compound for the coating. A nickel alloy is especially suitable for hydrostatic hot extrusion and a tin alloy for hydrostatic cold extrusion. It is also very advantageous if the metallic compound contains anti-corrosion constituents such as chromium, cobalt or molybdenum. Such constituents furthermore obviate the necessity of using a buffer gas atmosphere if the pre-molding is, for example, being hot-extruded.

By means of the metallic compound envisaged, which is most effectively fused onto the pre-molding during the sintering process, a liquid-tight surface is obtained, so that the pre-molding can be extruded hydrostatically under direct contact with the pressure medium. The impervious surface is achieved as a result of the capillary effect present in the pores of the pre-molding, since this causes the pores in the skin zone of the pre-molding to be effectively and completely filled up with a portion of the molten coating material. Because of this intimate bonding between the pre-molding and the coating layer and the nature of the coating, it is possible for the coating to be shaped along with the molding without cracking during extrusion and for the extruded molding to receive a nonporous, smooth external and/or internal layer.

Manufacture of the molding according to the invention is further simplified by another feature of the invention, in that, for preparation of a powder blank from which the pre-molding is produced, a cylinder rotating about its horizontal axis is used, into whose center the coating is introduced in powdered form; the actual powdered material for the molding then is introduced in the same manner, the powdered materials being distributed evenly inside the cylinder by the centrifugal force. The special advantage of this processing method lies in the fact that the coating material is applied to the powder blank at the same time as the latter is itself being prepared, that is, a separate processing stage for the application of the coating material is rendered unnecessary.

If, for example, a molding of hollow cross-section is to be manufactured, it is equally possible for the internal and external surfaces to receive coatings. It may furthermore be advantageous for these coatings to be of differing composition. This may be advisable, for example, in the case of cylindrical moldings which are to be used for transporting chemical substances. For such applications it may be sufficient for the coating of the internal surface to consist of a metallic compound resistant to specific chemicals, while the coating of the external surface need only be resistant to ordinary corrosion.

It may, however, be advantageous to apply the coating in paste form to the pre-molding after the latter has been prepared. A paste consisting of soldering powder and distilled water is particularly suitable for this purpose, and the addition of an adhesive may also be useful.

Further details and features of the invention are evident from the following description of several drawings.

DETAILED DESCRIPTION OF THE PREFERRED EMBODIMENTS

Figure 1:
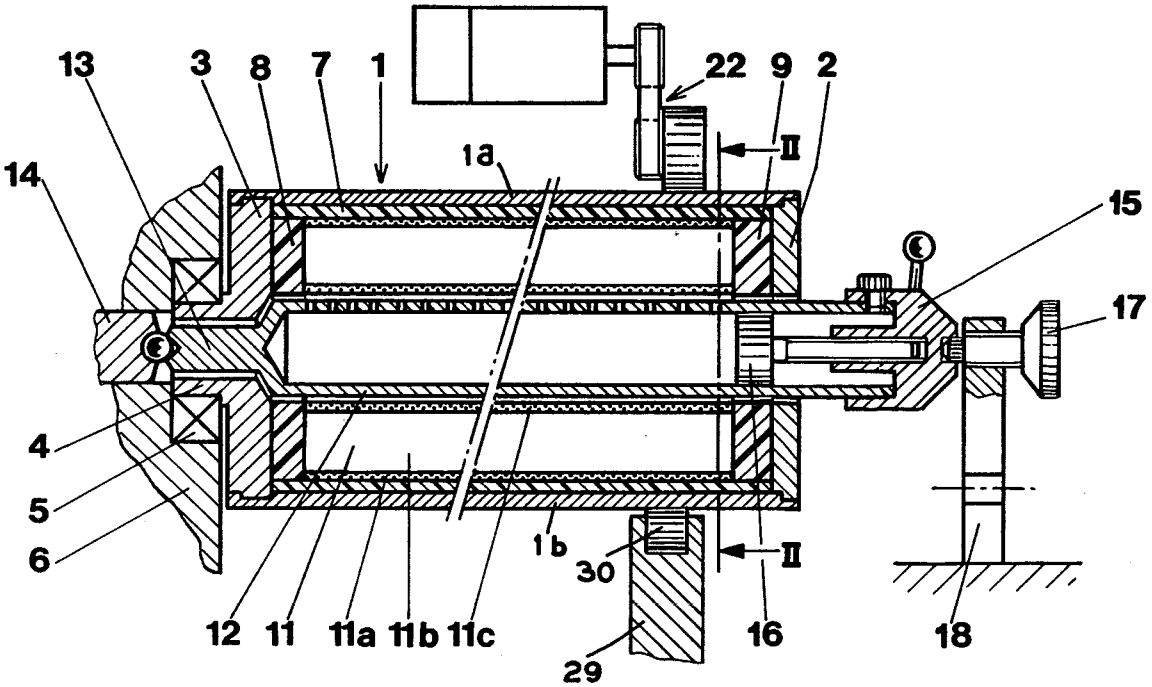
FIG. 1 is an elevation view in section of an apparatus for manufacturing a multilayer powder blank.
Figure 2:
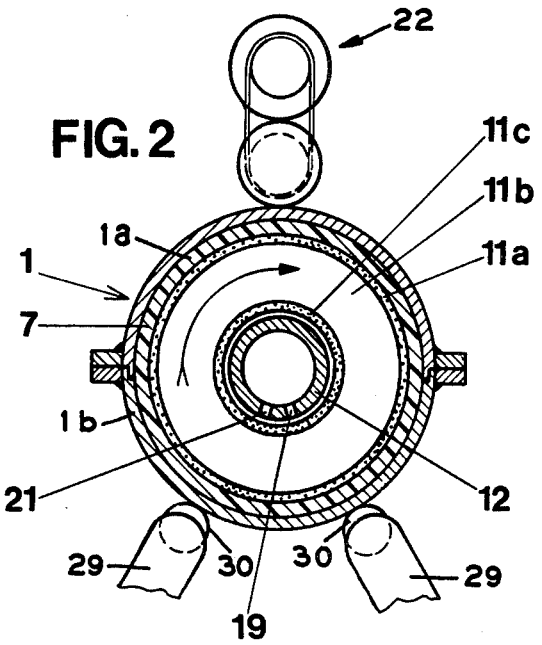
FIG. 2 is a transverse cross-sectional view taken along line II—II of FIG. 1.

The device shown in FIGS. 1 and 2 is particularly suitable for the preparation of a multilayer powder blank, from which the molding which is the subject of the invention can then be manufactured. This device has a cylindrical container 1, which possesses an external jacket consisting of two half-shells 1*a*, 1*b* (FIG. 2), at whose two extremeties are covers 2 and 3. The left-hand cover 3 has a central hollow pin which is swivel-mounted in a retaining wall 6 by means of a roller bearing 5.

Located inside the container 1 is an elastic tube 7 which is sealed off by two side walls 8 and 9. The elastic insert 7–9 forms the bed for a powder blank labelled 11. Coaxially to the container 1 runs a filling tube or powder distribution means 12 which, with a tapered end section 13, is swivel-mounted by means of a ball joint to a shaft 14 located in retaining wall 6. On the other side of filling tube 12 is a plug 15 with an axially adjustable slide 16. A setscrew 17 located in a swivelling support 18 engages in plug 15 as a guide for the filling tube 12. The container rests with its open end on two opposed support arms 29 in splay arrangement, each with a roller at its upper extremity.

As is further evident from FIG. 2, the filling tube 12 has radial drillholes 19 and 21 arranged in two axially disposed series and serving as outlet apertures for the powdered material in the interior of the container 1.

The method of operation is as follows: the filling tube 12 is at first outside the container 1 and is filled with an amount of metal powder depending on the required layer thickness, which melts during the further processing of the molding being manufactured and becomes the fused-on external coating 11*a*. The plug 15 with slide 16 is then placed on the filling tube 12 which is then introduced axially into the container 1 from the right-hand side, the support 18 having first been swivelled aside. The filling tube 12 is then fixed in position and the container 1 is set in rotary motion by means of a conventional friction drive 22. When a certain rotational speed is reached, the filling tube 12 is rotated until its holes 19 and 21 are facing downwards and the powder with which it has been filled can trickle out—see FIG. 2. The rotation of the container 1 causes the powder to be spread evenly over its internal circumferential surface and to remain in place because of the centrifugal force (this is, compressed to some extent).

As soon as filling tube 12 is empty it is replaced by a similar filling tube which is filled to the desired amount with another powdered substance 11*b*, for example, the base substance for the molding. The rotational speed of the container 1 is naturally maintained during this operation, in order that the layer already distributed inside does not slip off. The application of separate powder layers is now repeated until the powder blank 11 has reached its final internal diameter. Since in this example a cylindrical molding is to be produced, a soldering material is used for the internal layer 11*c* which serves as a fuse-on coating for the internal cylindrical surface. This type of method has the valuable advantage that, if required, a relatively inexpensive powder can be used for the core layer 11*b* of the powder blank 11, while a higher-grade material can be used for the surface layers 11*a* and 11*c*.

When the container 1 is filled, the elastic insert 7–9 is removed from it and molded isostatically by a known method, so that the powder blank 11 is given a certain inherent strength for the subsequent sintering. In this sintering process the powder blank 11 is heated until layers 11*a* and 11*c* melt. These layers should optimally have a fusion temperature which is somewhat lower than the sintering temperature of the core layer 11*b*. This arrangement yields the advantageous possibility in one and the same heating process of sintering the powder blank 11 while simultaneously providing it with the suitable coating layer which effectively seals the powder blank so that it can be hydrostatically extruded.

Figure 4:
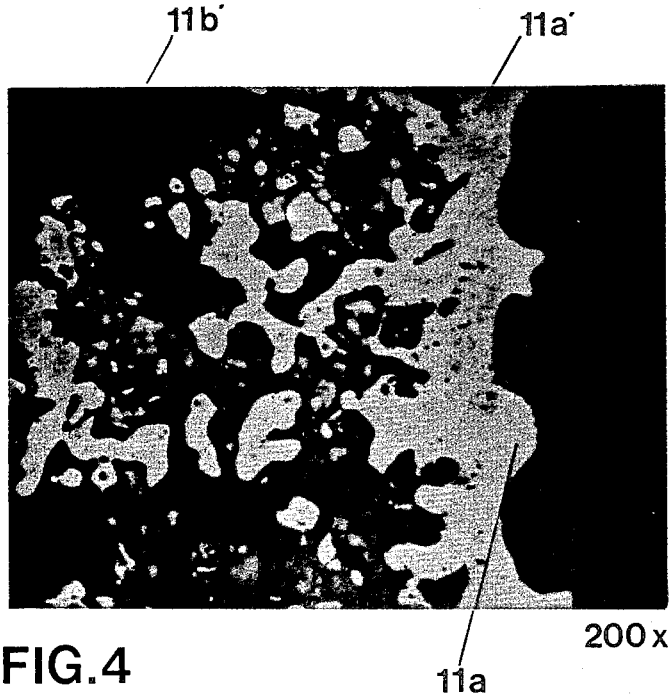
FIG. 4 is a section of the micrograph shown in FIG. 3, 200 times magnified.
Figure 3:
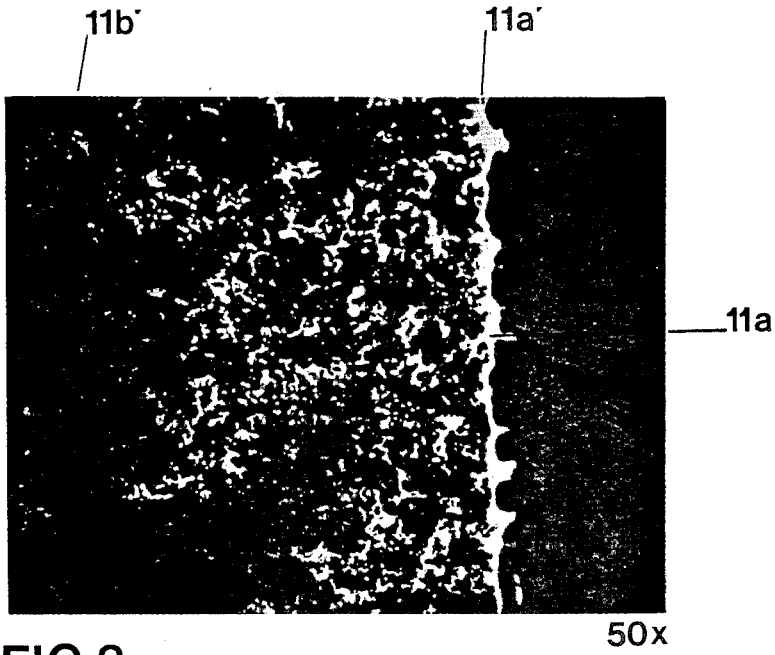
FIG. 3 is a micrograph of the skin zone of a sintered pre-molding, showing the coating, 50 times magnified.

FIGS. 3 and 4 show micrographs of the skin zone of a sintered pre-molding. The molten coating which has partially penetrated into the pores, labelled as 11*a*', appears white and is clearly distinguishable. The sintered core layer of the pre-molding designated as 11*b*' appears black. To the right of the surface layer is a plastic material which appears black and which was required for preparation of the micrograph.

FIG. 4 shows with particular clarity that the solder has penetrated about one millimeter deep into the surface, filling all the pores. The external layer 11*a*' is several tenths of a millimeter thick and forms a continuous, impervious outer skin as shown in particular by the 200 times magnification in FIG. 4.

Figure 5:
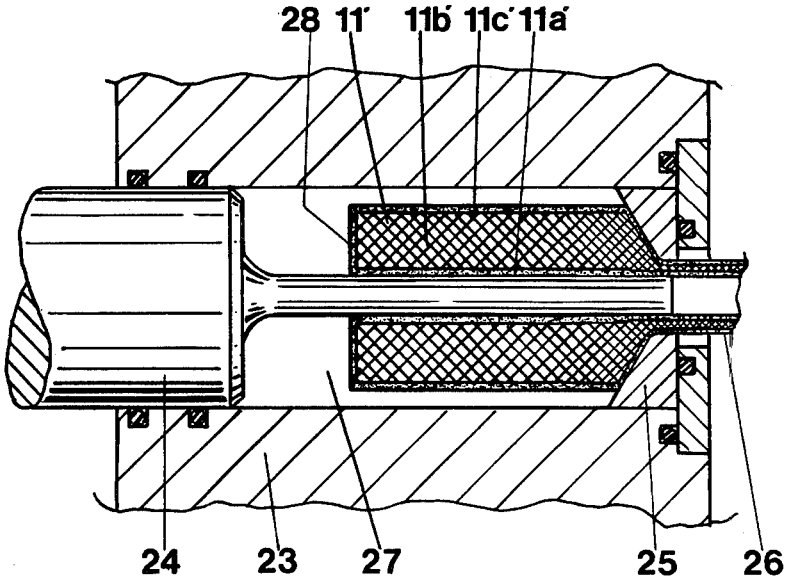
FIG. 5 is an elevation view in section of a die for hydrostatic extrusion of tubular moldings.

FIG. 5 shows schematically a die with which the sintered pre-molding 11' can be hydrostatically extruded to form a tubular molding. In this process a cylinder 23 is closed at one end by a sliding pressure ram 24, at its other end by a die 25 with the cross-section of the molding 26 to be manufactured. The cylinder volume not filled by the pre-molding 11' is occupied by a liquid pressure medium 27, in the present instance oil.

In the extrusion process, the axial pressure of the ram 24 spreads in all directions in the pressure medium 27, so that the pre-molding 11' is forced through the die 25 by the hydrostatic compressive force. The fused-on coatings 11*a*' and 11*c*' prevent the pressure medium 27 from penetrating into the pores of the pre-molding 11' during this process and at the same time serve as a lubricant during extrusion through the die 25. Since the pre-molding 11 made with the device in accordance with FIG. 1 has no coating on its front surface, this must be covered before sintering of the pre-molding 11. This can be effected by application to this uncovered front surface, designated as 28, a paste of soldering powder. Use of a paste of this kind is shown to be another method of applying the coating.

It may thus be advantageous in many cases to first prepare a pre-molding by the conventional method and then to apply to it a coating in the form of a paste of metal powder. The powdered material used should be selected so as to melt during sintering of the pre-molding and to form the desired impervious outer skin.

For best results, the paste should consist of a mixture of a soldering powder with a liquid, particularly distilled water. An adhesive may also be added in order to improve the adhesion of the paste to the pre-molding. Cellulose adhesives may be considered as suitable for this purpose, and should be added in the proportion of 0.5% by volume, relative to the liquid proportion of the paste.

When the surfaces of the pre-molding which are to be treated have been coated with the soldering powder paste, they are first dried and then heated so that the soldering powder melts and fills in the pores. The base material of the pre-molding is also sintered in the same heating cycle. The sintering temperature depends, as is well-known, on the physical properties of the powdered materials used. It also determines the choice of soldering material which in all cases must melt at the sintering temperature.

What is claimed is:

1. In an apparatus for manufacturing a multilayer annular-shaped powder blank to be subsequently compressed, sintered and extruded, said blank having an intermediate core part and outer and inner layers which are fused into outer and inner, water-tight circumferential coatings respectively, the improvement comprising:

(a) a base, (b) a hollow container comprising cylindrical side walls and opposite first and second end walls defining an inner space, and a central axis, (c) means for supporting said container on said base and for rotating said container about said central axis, (d) an annular-shaped elastic liner removably mounted in said container adjacent said cylindrical side and end walls thereof, said liner having a permanent annular shape whose side walls are continuous and define in cross-section a continuous periphery surrounding a hollow space, and (e) powder distribution means loadable with a first powder and positionable within said liner's hollow space within said container's inner space for distributing said first powder radially outward, while said container is rotating, onto said liner, thereby forming said outer layer of said blank, which layer remains generally stable on said liner due to centrifugal forces acting thereon, and for similarly and successively distributing second and third powders, thereby forming said intermediate part and said inner layer respectively of said blank, said liner and included layers of powder being removable from said container for subsequent isostatic compression and sintering of said combined layers and fusion of said inner and outer layers into said water-tight coatings, said powder distribution means further comprising a tube having a longitudinal axis, a row of apertures disposed generally axially along and extending through a wall of the tube, and guide means for inserting said tube generally axially through one end and into the inner space of said container and for rotating said tube about its own axis until said apertures are directed generally downward, whereby said powder may fall downward onto said rotating container and liner forming each of said annular layers thereon, said guide means also providing for axial removal of said tube while said container and liner are rotating.

2. Apparatus according to claim 1, wherein said distribution means tube has a central axis which is positionable coaxially with the central axis of said container.

3. Apparatus according to claim 2, wherein said means for supporting said container orients said central axis thereof generally horizontally.

4. Apparatus according to claim 1, wherein said container end walls include coaxial openings therethrough, and said distribution means tube is insertable through at least one of said openings in said container.

5. In an apparatus for manufacturing a multilayer annular-shaped powder blank, the improvement comprising:

(a) a base, (b) a hollow container comprising cylindrical side walls whose inner surfaces define an inner space, and a central axis, (c) support means for supporting said container on said base, and for rotating said container about said central axis, (d) powder distribution means loadable with a quantity of powder and positionable within said container's inner space:

(i) for distributing said powder radially outward, while said container is rotating, onto said inner surfaces and uniformly along the length of said container side walls, thereby forming an outer first powder layer of said blank, which layer remains generally stable due to the centrifugal forces acting thereon, and (ii) for similarly and successively distributing additional quantities of powder, thereby forming additional layers of said powder blank positioned successively radially inward of said first layer, and (e) means for removing said blank from said container, said support means orienting said container and its central axis generally horizontal, and said powder distribution means further comprising a tube having a row of apertures disposed generally axially along and extending through a wall of said tube, and said apparatus further comprising means (i) for inserting said tube loaded with powder generally axially into said container's inner space along the central axis thereof and for rotating said tube, while said container is rotating, until said apertures are directed generally downward, whereby said powder falls downward and is thereby distributed forming one of said layers of the powder blank, and (ii) for withdrawing said tube from said inner space while said container and layered powder are rotating.

* * * * *